US006300912B1

(12) United States Patent
Pla

(10) Patent No.: US 6,300,912 B1
(45) Date of Patent: Oct. 9, 2001

(54) COMPACT MOUNTABLE DIPOLE ANTENNA

(75) Inventor: Raul J. Pla, Miami, FL (US)

(73) Assignee: Antenna World, Inc., Miami, FL (US)

( * ) Notice: Subject to any disclaimer, the term of this patent is extended or adjusted under 35 U.S.C. 154(b) by 0 days.

(21) Appl. No.: 09/520,100

(22) Filed: Mar. 7, 2000

(51) Int. Cl.[7] ..... H01Q 1/32

(52) U.S. Cl. ..... 343/713; 343/715; 343/888; 343/901; 343/906

(58) Field of Search ..... 343/711, 713, 343/715, 793, 807, 888, 892, 823, 900, 901, 906; H01Q 1/32

(56) References Cited

U.S. PATENT DOCUMENTS 2,604,593 * 7/1952 Trowbridge ..... 250/33
4,523,197 * 6/1985 Imazeki ..... 343/702
4,804,973 * 2/1989 Ackman ..... 343/888
5,805,113 * 9/1998 Ogino et al. ..... 343/713
6,019,340 * 2/2000 Hanaoka ..... 248/515

* cited by examiner

*Primary Examiner*—Don Wong
*Assistant Examiner*—Shih-Chao Chen
(74) *Attorney, Agent, or Firm*—Martin Fleit

(57) ABSTRACT

A compact, simple to install dipole antenna that has a base composed of a molded plastic mass in the shape of a modified D-shape and having a flat face. A pair of spaced, coaxially aligned brass cores are encapsulated in the plastic mass of the base with threaded portions of the cores projecting axially out of the plastic mass of the base. A coaxial cable, having an outer conductor and an inner conductor, has one end encapsulated in the plastic mass of the base. Connectors directly connect the outer conductor of the coaxial cable to one of the brass cores, and the inner conductor with the other brass core. A pair of telescoping brass pole elements are threadedly mounted on the threaded projections.

11 Claims, 4 Drawing Sheets

COMPACT MOUNTABLE DIPOLE ANTENNA

BACKGROUND OF THE INVENTION

1. Field of the Invention

The present invention relates to a compact dipole antenna with telescopic elements for mounting inside of vehicles, offices, homes or boats.

2. Description of the Related Art

Antennas exist for vehicles, offices, homes or boats, but the need still exists for a small, compact antenna that can be easily mounted, is simple in construction, is simple to manufacture, is simple to install, is tunable and which can be easily repaired.

SUMMARY OF THE INVENTION

The present invention in its broadest form comprises a compact, simple to install dipole antenna comprising a base having a flat face, a pair of spaced, brass cores contained in the base with portions of the cores exposed at discrete surfaces of the base, a coaxial cable having an outer conductor and an inner conductor with one end of the cable contained in the base, a first connector directly connecting the outer conductor of the coaxial cable to one of the brass cores, a second connector directly connecting the inner conductor with the other brass core, and a pair of telescoping brass pole elements mounted to the exposed portions of the cores.

In a more particular form, the invention consists of a compact, simple to install dipole antenna that has a base having a flat face, a pair of spaced, coaxially aligned brass cores contained in the base with threaded portions projecting, a coaxial cable having one end contained in the base, a first connector directly connecting the outer conductor of the coaxial cable to one of the brass cores, a second connector directly connecting the inner conductor of the coaxial cable with the other brass core, and a pair of telescoping brass pole elements each being threadedly mounted on one of the threaded projections.

DETAILED DESCRIPTION OF A PREFERRED EMBODIMENT

Figure 1:
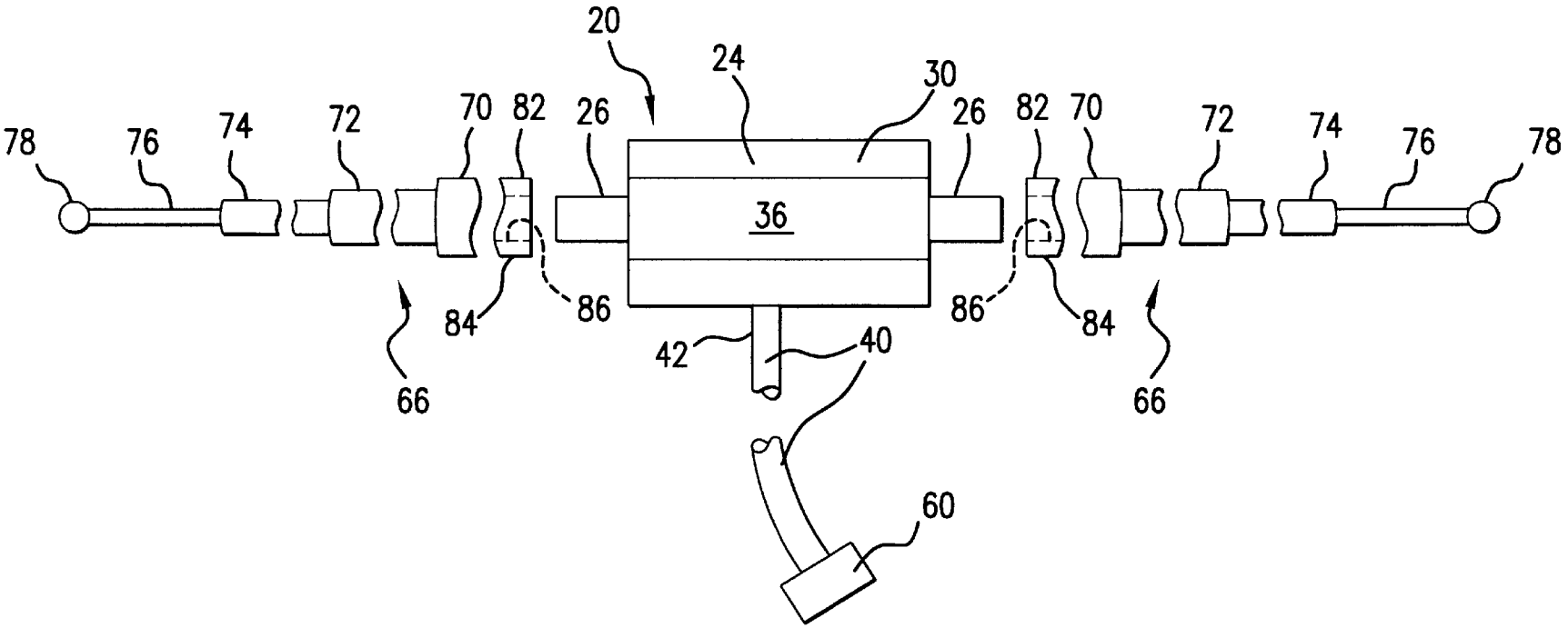
FIG. 1 is an exploded view taken from the side showing the novel antenna of the present invention.
Figure 3:
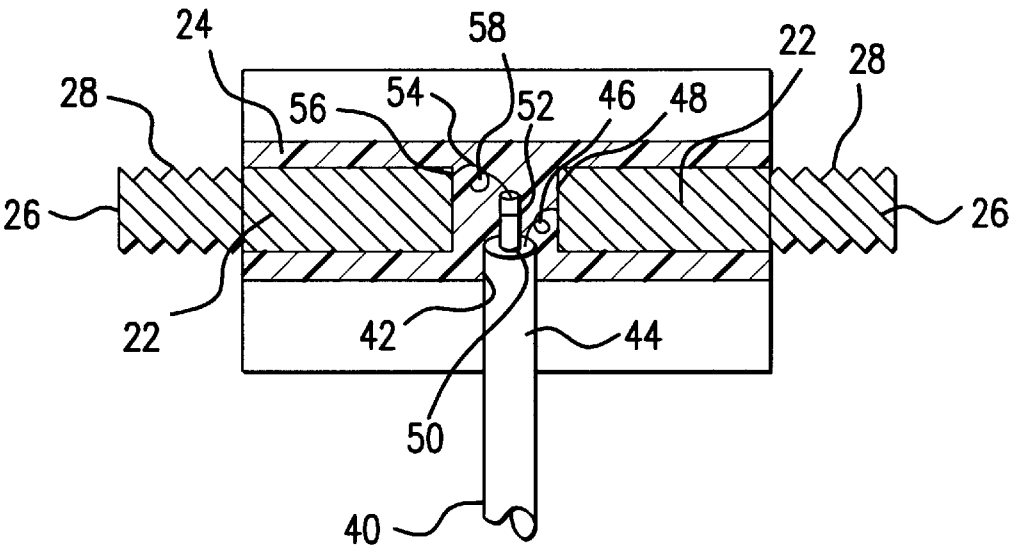
FIG. 3 is a sectional view of FIG. 2 taken along line 3—3.
Figure 2:
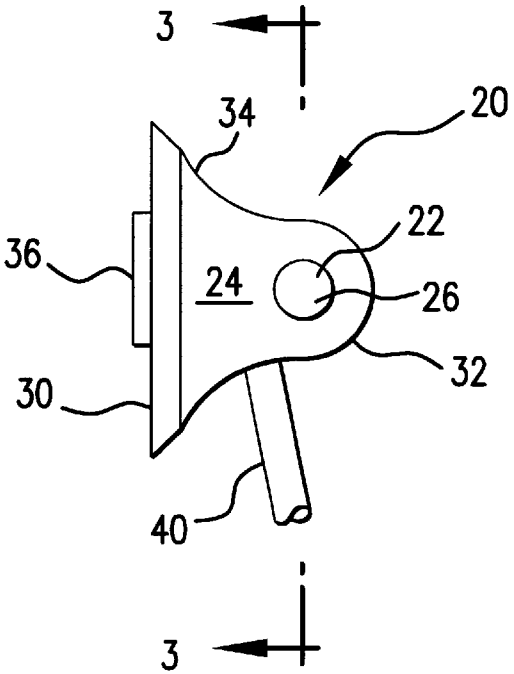
FIG. 2 is a side view of the base of the antenna with the telescoping dipoles left off.
Figure 4:
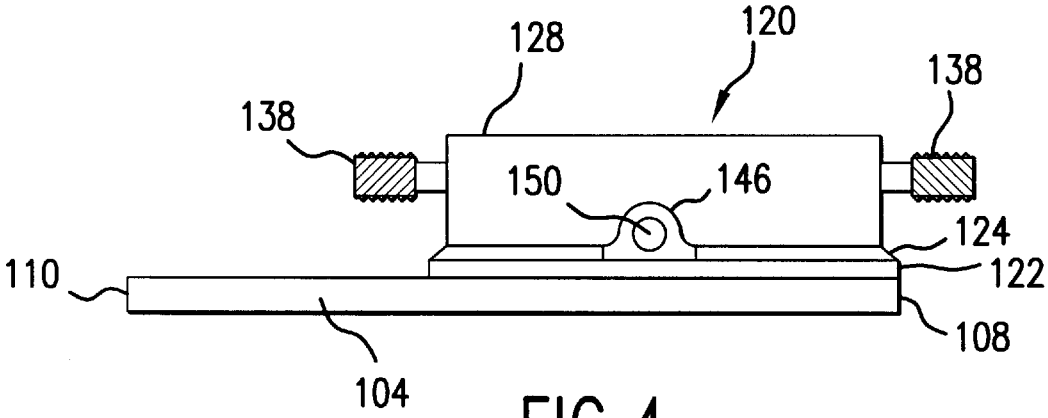
FIG. 4 is a side elevation of another embodiment.
Figure 5:
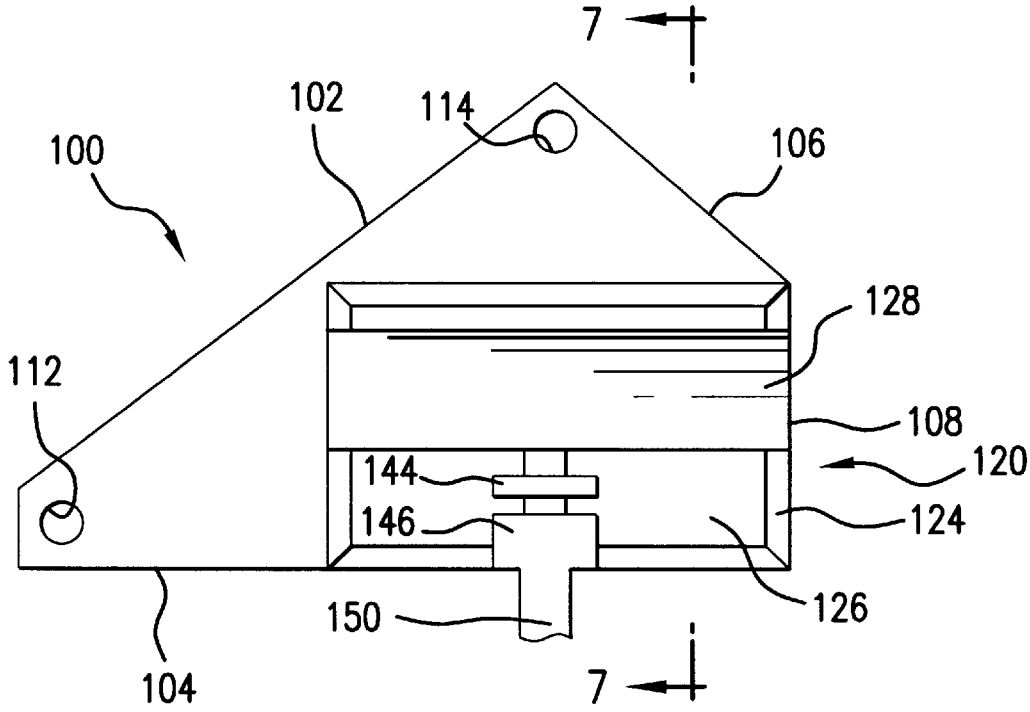
FIG. 5 is a plan view of the embodiment shown in FIG. 4.
Figure 6:
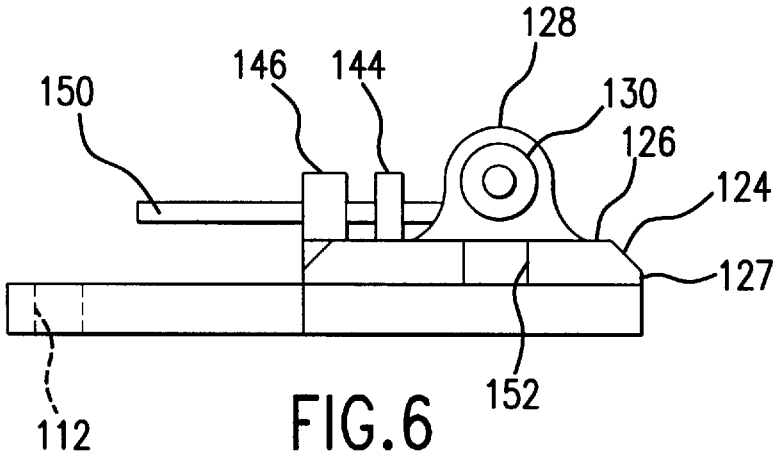
FIG. 6 is an end view of the embodiment shown in FIG. 4.
Figure 7:
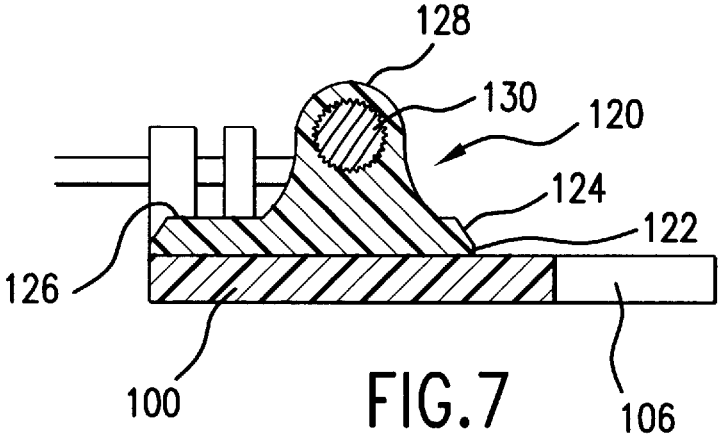
FIG. 7 is a view in section taken along line 7—7 of FIG. 5.

The novel compact antenna of the present invention as shown in FIGS. 1–3 is of simple design, simple to mount and can be easily repaired. The antenna of the present invention consists of a modified D-shaped molded base 20, a pair of telescoping dipoles 66, and a coaxial cable 40 provided with a termination 60. The molded base 20 is approximately 1 and ¼ inches long and about ¾ inch wide and consists of a pair of spaced, axially aligned, cylindrical brass cores 22 that are encapsulated in a body of plastic 24, preferably by injection molding. Cores 22 have axially projecting studs 26 on which are cut threads 28 on their outer cylindrical surface to provide threaded male parts. Studs 26 project out of the plastic body 24, and may be provided with a shoulder, not shown, defined between the main part of core 22 and the stud 26, in which circumstance, the stud 26 is of reduced diameter from that of the core 22. If no shoulder is present, the diameter of the stud is the same as the core. The modified D-shaped molded base 20 has a flat face 30 on one side, and curves in a loop 32 on the other side. The cores 22 are encapsulated in about the center of the base 20 in the loop portion 34. A double-sided adhesive tape 36 is attached on one of its sides to the face 30 of the molded base 20, and its outer side is covered with a removable covering of paper or plastic film, not shown, to protect it until the antenna is to be mounted.

One end 42 of a coaxial cable 40 extends into the molded base 20 terminating in between the cores 22, as will be evident from FIG. 3. The outer conductor 44 of the cable 40 is connected to one of the brass cores 22 by a wire 46 that is soldered to the core 22 at contact 48 and to the outer conductor 44 by contact 50. The inner conductor 52 of the coaxial cable 40 is connected to the other one of the brass cores 22 by a wire 54 that is soldered to the core 22 at contact 56 and to the inner conductor 52 by contact 58. As will be evident, the connections to the cores 22 from the coaxial cable 40 are direct. This is an important feature of the invention. Also, it will be evident from the drawings that the end 42 of cable 40, and the connections to the cores 22 are encapsulated in the molded base 20 during the injection molding thereof.

Coaxial cable 40 is about 9 to 12 feet in length and about ⅛ inch in diameter. Such cables are commercially available. The free end of the coaxial cable 40 is provided with a termination 60 which may be anyone of a type F plug for television, a BMC or SMA type plug for radio or a nipple of general design, commercially available, which will adapt to connection to any electronic device that requires an antenna.

Mounted on each threaded stud 26 is a telescopic pole element 66 consisting of four tubes 70, 72, 74 and 76 which nest together to form a telescopic structure in a known manner. A ball element 78 is mounted on the free end 80 of tube or rod 76 to prevent its total retraction into the tube 74 with which it nests. The free end 82 of the largest tube 70 is provided with a solid portion 84 in which is formed a threaded bore or recess 86 to form a female part matching with the male part of threaded stud 26 on which it is threadedly mounted. The elements 66 are made of brass tubing and are plated with a black chrome finish in a known manner. Each element 66 is about 5 inches long when retracted, and is extendable to about 25 inches long. By this means, it is possible to tune the antenna by adjusting the degree of extension of each element 66.

Even though the invention has been described with the brass cores 22 having projecting studs 26, it is possible that the brass cores have an axially threaded bore or recess in one end, and the telescoping pole elements 66 be fitted with an axial threaded projection at its large end o mate with and threadedly engage with the threaded bore. In other words, the male and female parts of the joint can be reversed. Although this modification is not equivalent to the preferred embodiment described, nevertheless, it is a design possibility. Further it is possible to use a camming bayonet joint between the end of the brass cores and the large ends of the telescoping elements 66, and to this end, these parts will be appropriately modified. The important point in this regard is that the elements 66 can be easily and quickly mounted and detached. This is particularly helpful in case of repair due to damage to the elements 66.

To mount the inventive antenna, a mounting surface, such as, a windshield or window or other flat surface is selected. The surface is then cleaned, particularly to degrease the surface, and then, the protective covering for the adhesive strip 36 is removed, and the base 20 is pressed against the surface. Thereafter, the elements are mounted to the base 20 by threading or otherwise as described, and extended or retracted to tune the dipoles to the desired frequency. A suitable electronic device is plugged into the coaxial cable 40 by connecting to the termination 60.

Figure 8:
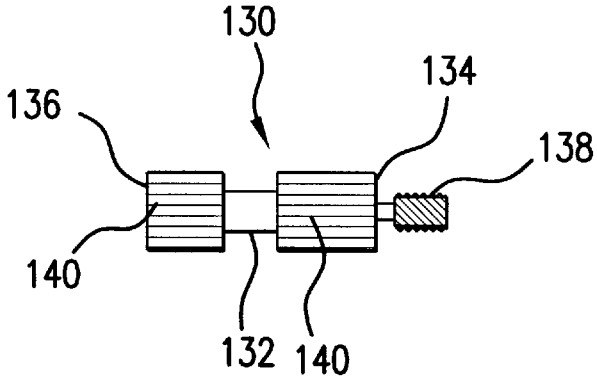
FIG. 8 is a detail of the brass core of the embodiment of FIG. 4.

A second and preferred embodiment is shown in FIGS. 4–8. In this embodiment, the antenna consists of a clear plastic mounting plate 100 of pentagonal shaped having long sides 102 and 104 and short sides 106 and 108 with the fifth side 110 being the shortest. Adjacent the shortest side 110 is a through bore 112. At the apex of the sides 102 and 106 is another through bore 114. The antenna proper is secured to the face of the mounting plate 100 by glue or an adhesive. The body 120 of the antenna consists of an injection molded piece that is flat on the bottom to secure to the mounting plate 100. A thin lip 122 surrounds body 120 and an inclined or beveled portion 124 extends form lip 122 upwardly to a flat surface 126. Off center axially or transversely, the body 120 extends upwardly in the form of a cylinder 128 within which is encapsulated brass cores 130. The brass cores 130 are shown in FIG. 8 and consist of a solid brass piece, circular in cross section that has a reduced diameter section 132 between end sections 134 and 136. End section 134 had an axial projection 138 that is threaded for mounting the telescoping dipoles in the manner described in conjunction with FIGS. 1–3. Both of sections 134 and 136 are knurled on their surfaces as indicated in FIG. 8 by the reference numeral 140. Injection molded as part of body 120 are two spaced half rounds 144 and 146 that serve to hold the coaxial cable 150 that is connected to the two cores 130 in the manner previously described. At the ends of body 120 there are cutouts 152 to accommodate the ends of the dipoles.

Although the invention has been shown and described in terms of a preferred embodiment, nevertheless changes and modifications will be apparent from the above disclosure and its teachings. Such changes and modifications as will be evident to those skilled in the art are deemed to come within the purview of the invention as set forth in the appended claims.

What is claimed is:

1. A compact, simple to install dipole antenna comprising a pair of elongated brass cores axially aligned end-to-end with the adjacent ends of the brass cores spaced apart, a plastic mass encapsulating the brass cores with the remote ends of the brass cores exposed at opposite sides of the plastic mass, a flat mounting surface defined by the plastic mass, an adhesive covering the flat mounting surface to enable mounting directly on a flat surface, a coaxial cable having an outer conductor and an inner conductor with one end of the cable encapsulated in the plastic mass and lying in proximity to the adjacent ends of the brass cores, a first connector directly connecting the outer conductor of the coaxial cable to one said adjacent end of one brass core, a second connector directly connecting the inner conductor of the coaxial cable to said other adjacent end of said other brass core, and a pair of telescoping brass pole elements mounted coaxially to the remote exposed ends of the brass cores.

2. The compact, simple to install dipole antenna according to claim 1 wherein the direct connections are effected by solder contacts.

3. The compact, simple to install dipole antenna according to claim 1 wherein the telescoping brass pole elements are plated with black chrome.

4. The compact, simple to install dipole antenna according to claim 1 wherein the base is about 1¼ inches long and about ¾ inches wide.

5. The compact, simple to install dipole antenna according to claim 1 wherein the telescoping brass pole elements retract to about 5 inches long and extend to about 25 inches long for tuning of the antenna.

6. The compact, simple to install dipole antenna according to claim 1 wherein a termination is mounted on the free end of the coaxial cable to enable connection to an electronic device that requires an antenna for operation.

7. The compact, simple to install dipole antenna according to claim 6 wherein the termination is selected from the group consisting of an F type plug, a BBMC type plug, a type plug and a nipple.

8. The antenna as defined in claim 1 wherein the outer surface of each brass core has radial geometry that resists rotational force imposed on the brass core.

9. The antenna as defined in claim 1 wherein the outer surface of each brass core has an axial geometry that resists axial force imposed on the brass core.

10. The antenna as defined in claim 1 wherein the plastic mass is in the shape of a modified D-shape.

11. The antenna as defined in claim 1 wherein the remote exposed ends of said brass cores define one of a threaded projection and a threaded recess, and the telescoping brass pole elements have one of a complementary threaded recess and threaded projection.

* * * * *